US005305618A

United States Patent [19]

Yabuta

[11] Patent Number: 5,305,618

[45] Date of Patent: Apr. 26, 1994

[54] KNITTING METHOD OF WEFT KNITTED FABRIC AND MULTIBED FLAT KNITTING MACHINE

[75] Inventor: Masahiro Yabuta, Wakayama, Japan

[73] Assignee: Shima Seiki Mgf. Ltd., Wakayama, Japan

[21] Appl. No.: 936,745

[22] Filed: Aug. 27, 1992

[30] Foreign Application Priority Data

Aug. 29, 1991 [JP] Japan ..... 3-245042

[51] Int. Cl.[5] ..... D04B 7/00

[52] U.S. Cl. ..... 66/64

[58] Field of Search ..... 66/64, 65, 60 R, 78, 66/70, 109, 121

[56] References Cited

U.S. PATENT DOCUMENTS 1,676,947 7/1928 Frazier ..... 66/64

4,905,483 3/1990 Shima ..... 66/64

*Primary Examiner*—Clifford D. Crowder

*Assistant Examiner*—John J. Calvert

*Attorney, Agent, or Firm*—Spensley Horn Jubas & Lubitz

[57] ABSTRACT

The multibed flat knitting machine has upper needle beds, lower needle beds disposed under the upper needle beds, respectively, with their heads located adjacent to those of the upper needle beds. Knock-over bits are placed in the heads of the upper needle beds so as to slide parallel to the sliding directions of the upper needles. The knock-over bits are capable of being advanced to a position where the loop holders of the knock-over bits are beyond a corresponding position of the needle hooks of the advanced upper needles to support the needle heads of the upper needles of the upper needle beds.

6 Claims, 19 Drawing Sheets

FIG. 22a
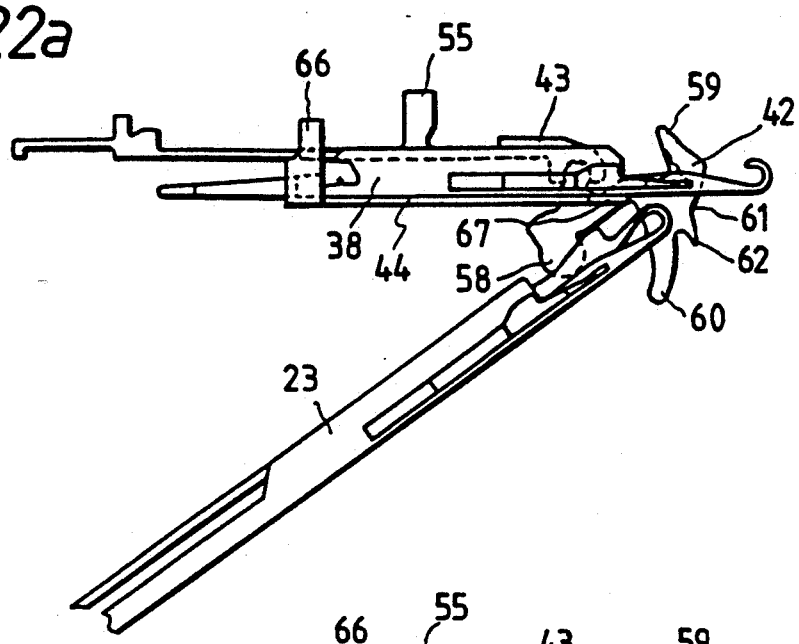
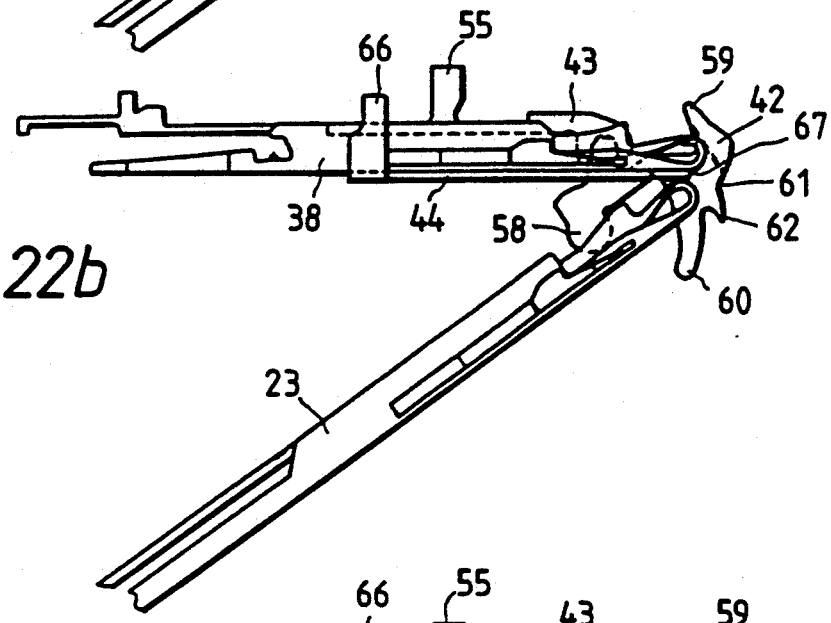
FIG. 22b
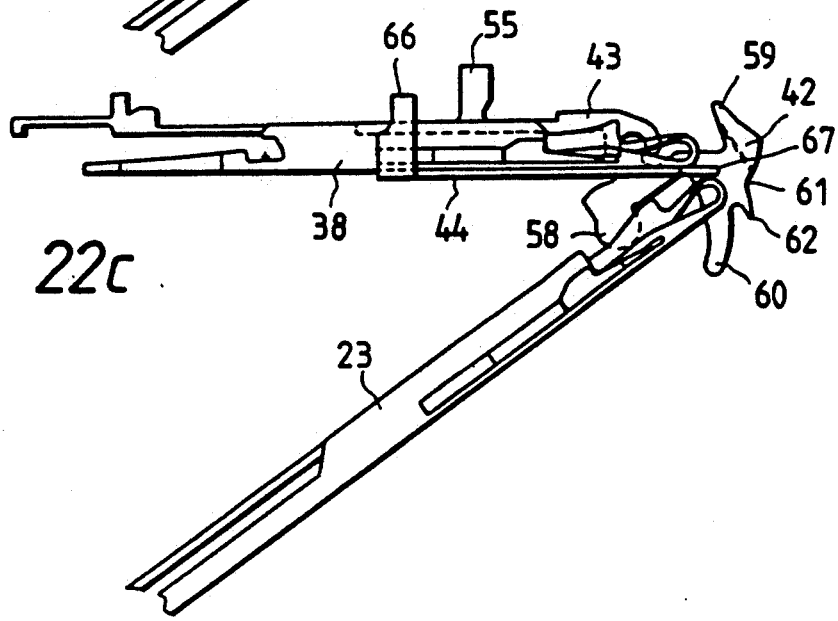
FIG. 22c

KNITTING METHOD OF WEFT KNITTED FABRIC AND MULTIBED FLAT KNITTING MACHINE

BACKGROUND OF THE INVENTION

The present invention relates to a knitting method of a knitted fabric by a multibed flat knitting machine and an improved multibed flat knitting machine.

PRIOR ART

The upper and lower needle bed of a multibed flat knitting machine, such as a four-bed flat knitting machine, are disposed with their edges located close to each other. Therefore, the hooks or the latches of the needles of the lower bed run against the head of the upper needle bed when the needles of the lower needle bed are raised to form stitches. To avoid the collision of the raised needles of the lower needle bed against the head of the upper needle bed, the upper needle bed is retracted when the needles of the lower needle bed are raised for stitching.

However, the retraction of the upper needle bed requires a complicated support mechanism for supporting the upper needle bed and it is difficult to advance and retract the upper needle bed with the head of the upper needle bed held in a correct position. Furthermore, the movement of the upper needle bed is liable to cause irregular stitches.

OBJECT AND SUMMARY OF THE INVENTION

The present invention has been made in view of the foregoing problems and it is therefore an object of the present invention to provide a multibed flat knitting machine comprising lower needle beds disposed with their head located close to each other, upper needle beds disposed over the lower beds, wherein the upper needle beds are held stationary when the needles of the lower beds are raised, and to provide a method of knitting a weft knitted fabric by such a multibed flat knitting machine.

According to a method of the present invention for knitting a weft knitted fabric by a multibed flat knitting machine having upper needle beds and lower needle beds disposed under the upper needle beds, respectively, a stitch is formed by retracting a knock-over bit slidably placed in the head of the upper needle bed to guide an upper needle from the path of a lower needle before the lower needle is raised. The multibed flat knitting machine for carrying out the method comprises upper needle beds, lower needle beds disposed under the upper needle beds, respectively, with their heads located adjacent to those of the upper needle beds, and knock-over bits placed in the heads of the upper needle beds so as to slide parallel to the sliding directions of the upper needles, capable of being advanced to a position where the loop holders of the knock-over bits are advanced beyond a position corresponding to the position of the needle hooks of the advanced upper needles to support the needle heads of the upper needles of the upper needle beds.

In forming a stitch with the lower needle, i.e., the needle of the lower needle bed, the corresponding upper needle, i.e., the needle of the upper bed, is lowered to a rest position and the knock-over bit supporting the upper needle is retracted to a retracted position to clear the advancing path of the lower needle before raising the lower needle for stitching.

In forming a stitch with the upper needle, the corresponding lower needle is lowered to a rest position and the knock-over bit provided on the upper needle bed is advanced to support the needle head of the raised upper needle. Thus, the knock-over bit serves as the bottom surface of the needle groove of the upper needle bed. The loop holder of the knock-over bit holds a loop formed by the needle hook of the upper needle when the upper needle is retracted.

BRIEF DESCRIPTION OF THE DRAWINGS

FIGS. 22*a*, 22*b* and 22*c* are side views of assistance in explaining the sequential motions of the sinker jack, the sinker, the knock-over bit, the upper needle and the lower needle to be performed subsequent to the state shown in FIG. 21*c*.

DETAILED DESCRIPTION OF PREFERRED EMBODIMENT

A multibed flat knitting machine in a preferred embodiment according to the present invention capable of carrying out a knitting method in accordance with the present invention will be described with reference to the accompanying drawings.

Figure 1:
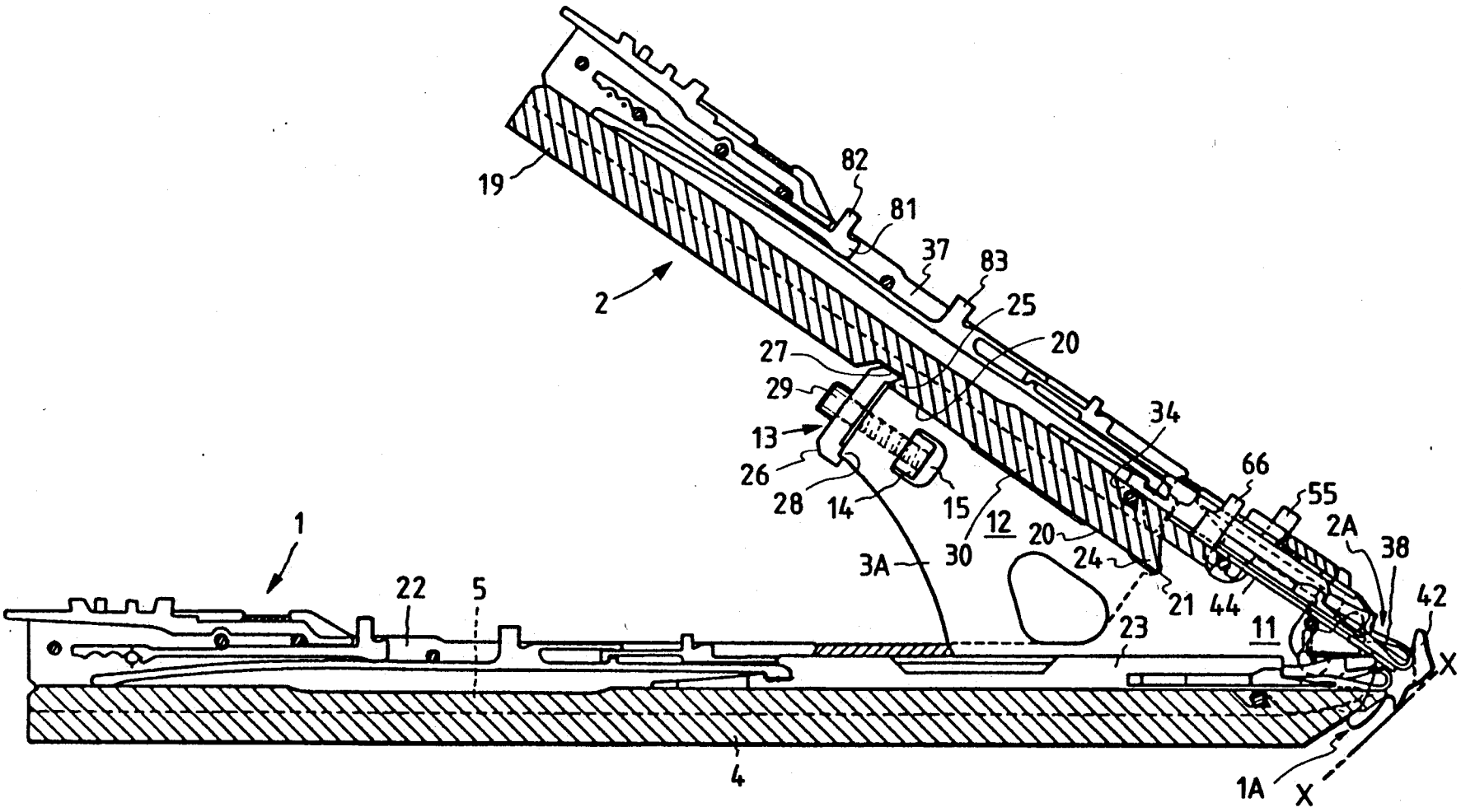
FIG. 1 is a general, schematic side view of a flat knitting machine, in which only one side of the flat knitting machine is shown.
Figure 2B:
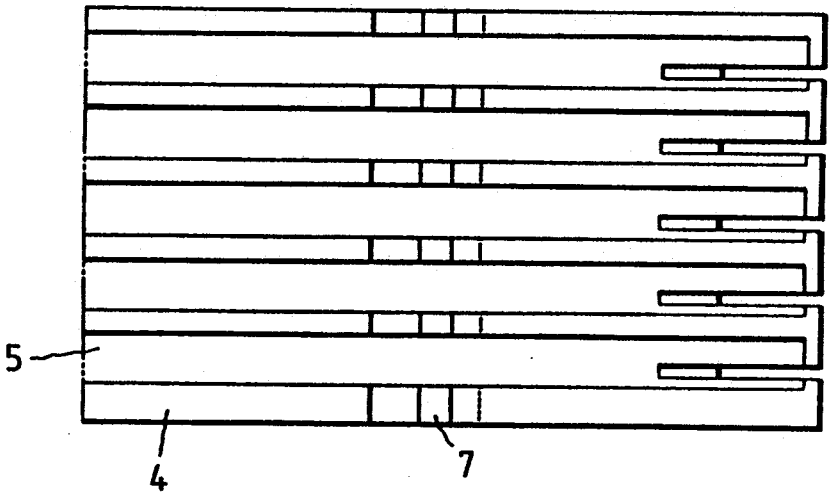
FIGS. 2*a* and 2*b* are longitudinal sectional view and an enlarged plan view, respectively, of a lower needle bed base plate.
Figure 2A:
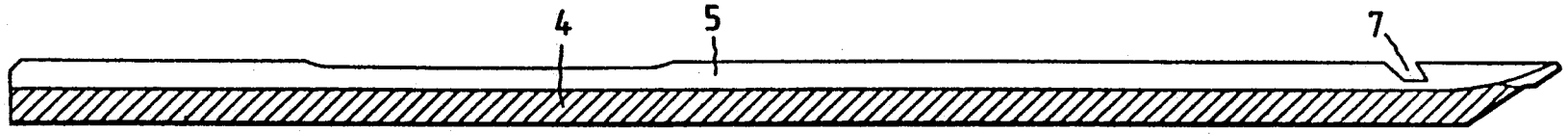

A flat knitting machine for carrying out the knitting method of the present invention is a four-bed flat knitting machine comprising lower needle beds 1 disposed opposite to each other so as to form an angle therebetween, and upper needle beds 2 held over the lower needle beds 1. The lower needle beds 1 and the upper needle beds 2 are disposed symmetrically with each other, respectively, with respect a center line X—X passing the middle of the gap between the front edges of the lower needle beds 1 and the upper needle beds 2. In FIG. 1, only the left half of the flat knitting machine is shown.

Figures 3A, 3B, 3C:
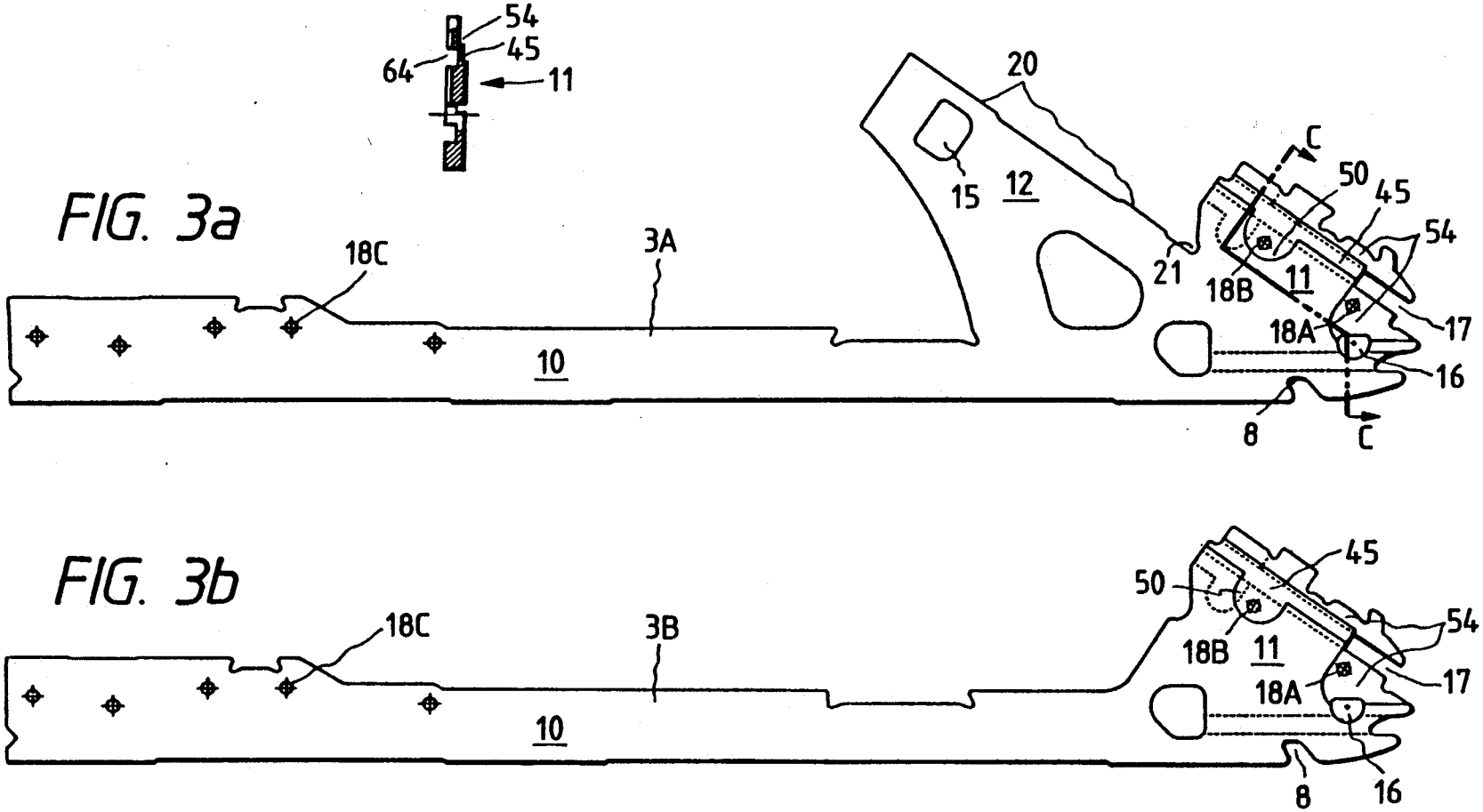
FIGS. 3*a*, 3*b* and 3*c* are a side view of a lower needle plate having an upper needle bed base plate supporting portion, a side view of a lower needle plate not having any upper needle bed base plate supporting portion and a sectional view taken on line C—C in FIG. 3*a*, respectively.
Figure 4B:
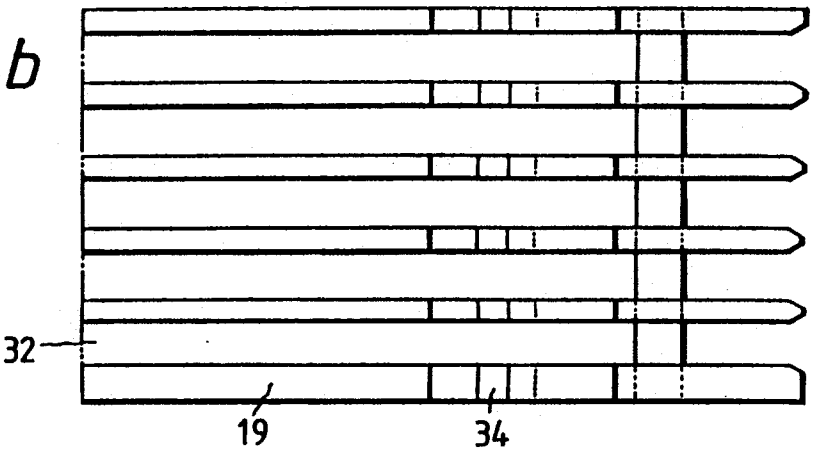
FIGS. 4*a* and 4*b* are a longitudinal sectional view and an enlarged fragmentary plan view, respectively, of an upper needle bed base plate.
Figure 4A:
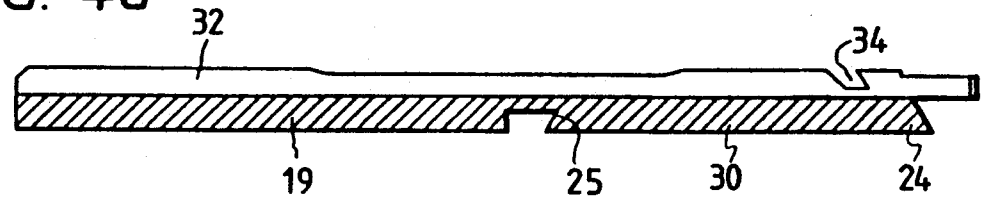
Figure 5B:
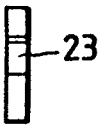
FIGS. 5*a* and 5*b* are a side view and a front view, respectively, of an upper needle plate.
Figure 5A:
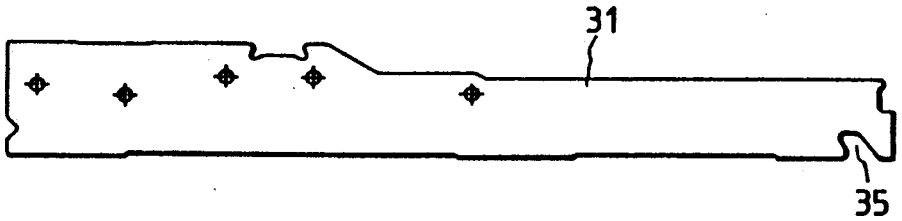
Figure 6:
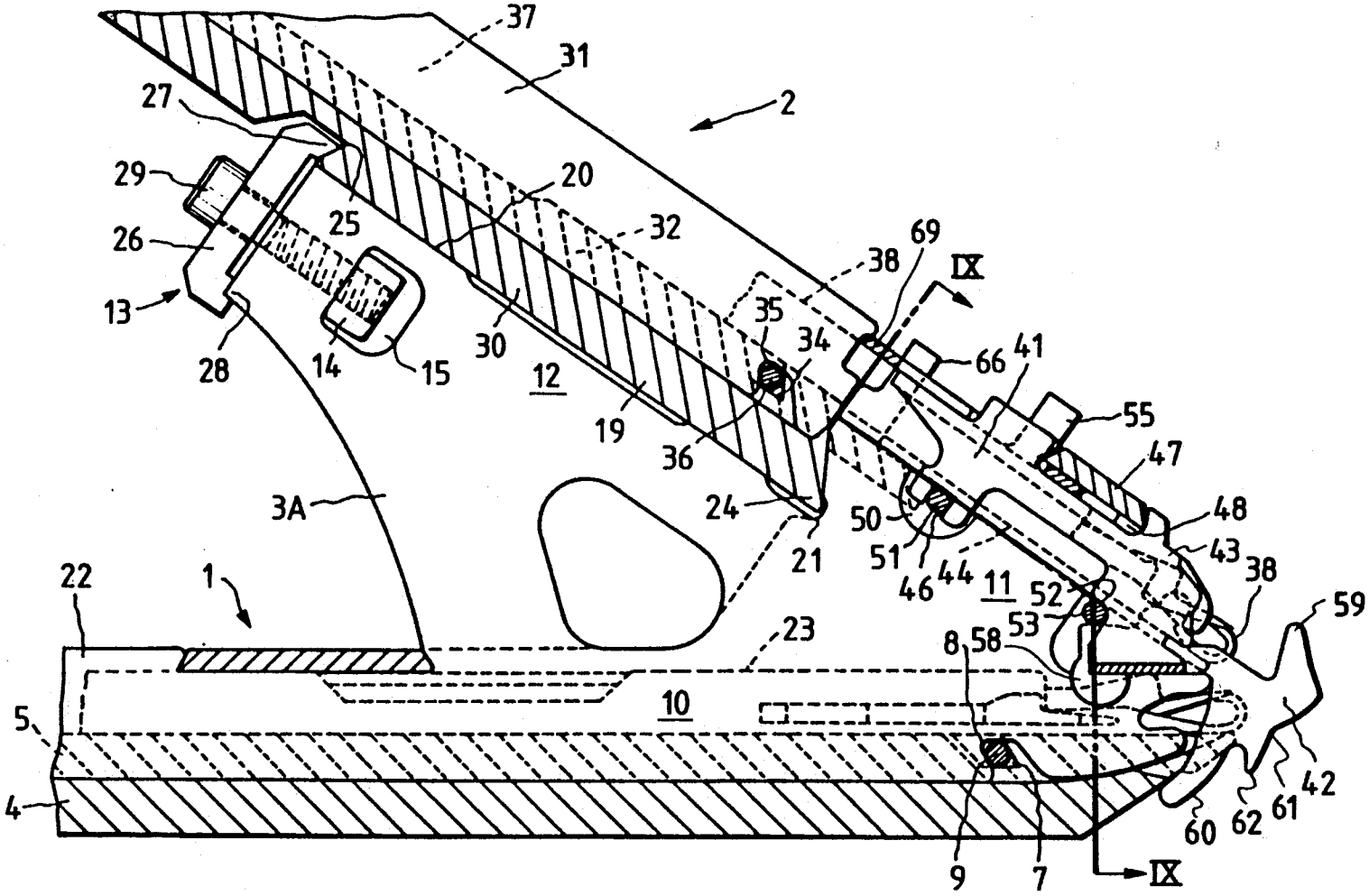
FIG. 6 is a sectional view taken on line VI—VI in FIG. 9.

In FIG. 1, the upper needle bed 2 is supported on the lower needle bed 1 by lower needle plates 3A. However, the lower needle bed 1 and the upper needle bed 2 may be supported by separate needle plates individually. A lower needle bed plate 4 is provided, similarly to the conventional needle bed, with a plurality of needle plate grooves 5. Lower needle plates 3A and 3B are inserted in the needle plate grooves 5, and a wire 9 is passed through recesses 7 formed in the needle bed base plate 4 and recesses 8 formed in the lower needle plates 3A and 3B to fasten the lower needle plates 3A and 3B to the needle bed base plate 4. As shown in FIG. 3*a*, the lower needle plate 3A has a lower needle guide portion 10 extending between the front edge and the rear edge of the lower needle bed 1, a needle plate head portion 11 extending upward from the front end of the lower needle guide portion 10, and an upper needle bed base plate supporting portion 12 extending upward from the upper edge of the lower needle plate 3A at a position behind the needle plate head portion 11. The lower needle plate 3A is provided with a fixed beam passing hole 15 through which a fastening beam 14 of an upper needle bed fastening member 13 is passed, a sinker holding hole 16, a needle blade guide groove 17, wire passing holes 18A, 18B and 18C, and other necessary holes. The upper needle bed base plate supporting portion 12 has an inclined support surface 20 for supporting an upper needle bed base plate 19 (FIGS. 4*a*, 4*b*). A wedge-shaped recess 21 is formed in the extension of the support surface 20 at the junction of the needle plate head portion 11 and the upper needle bed base plate support portion 12. As shown in FIG. 3*b*, the lower needle plate 3B is substantially similar in shape to the lower needle plate 3A, except that the lower needle plate 3B has no portion corresponding to the upper needle bed base plate supporting portion 12.

The lower needle plates 3A and 3B are inserted in the needle plate grooves 5 of the lower needle bed base plate 4. The lower needle plated 3A and 3B are arranged alternately or a plurality of sets each of one lower needle plate 3A and a plurality of lower needle plates 3B are arranged successively. The wire 9 is passed through the recesses 7 and 8 to fasten the lower needle plates 3A and 3B to the lower needle bed base plate 4 to form needle grooves 22 between the adjacent lower needle plates 3A and 3B. Lower needles 23 are received slidably in the needle grooves 22.

The upper needle bed 2 is fastened to the lower needle bed 1 with the fastening member 13. The needle plate head portions 11 of the lower needle plates serves as both the needle plate for the head 1A of the lower needle bed 1 and the needle plate for the head 2A of the upper needle bed 2. The fastening member 13 has a joining means for joining together the upper needle bed base plate 19 and the upper needle bed base plate supporting portion 12 of the lower needle plate 3A, consisting of a wedge-shaped edge 24 and a wedge-shaped recess 25, and a fastening means including a holding member 26.

The upper needle bed base plate 19 is put on the support surfaces 20 of the upper needle bed base plate supporting portions 12 of the lower needle plates 3A with the wedge-shaped edge 24 of the upper needle bed base plate 19 engaging the wedge-shaped recesses 21 of the lower needle plates 3A. The recess 25 of the upper needle bed base plate 19 corresponds to the rear end of the upper needle bed base plate supporting portion 12. A wedge-shaped edge 27 formed on one end of the holding member 26 having the shape of a flat bar and extended longitudinally of the flat knitting machine engages the recess 25 and the other end of the holding member 26 is in contact with the rear ends 28 of the upper needle bed base plate supporting portions 12 of the lower needle plates 3A. The holding member 26 is fastened to a fastening beam 14 extended longitudinally of the flat knitting machine through the fastening beam passing holes 15 of the lower needle plates 3A with bolts 29 to hold a dovetail portion 30 formed between the wedge-shaped edge 24 and the recess 25 of the upper needle bed base plate 19 between the wedge-shaped recesses 21 of the lower needle plates 3A and the wedge-shaped edge 27 of the holding member 26. Thus, the upper needle bed base plate 19 put on the lower needle plates 3A is fastened to the lower needle plate 3A.

FIGS. 4*a* and 4*b* and FIGS. 5*a* and 5*b* show the upper needle bed base plate 19 and an upper needle plate 31, respectively. The upper needle bed base plate 19 is provided with needle plate grooves 32 arranged at a pitch equal to that of the needle plate grooves 5 of the lower needle bed base plate 4 so as to correspond respectively to the needle plate grooves 5 of the lower needle bed base plate 4, and the upper needle plates 31 are inserted in the needle plate grooves 32, respectively.

A wire 36 is passed through recesses 34 formed in the upper surface of the upper needle bed base plate 19 near the front edge of the same and recesses 35 formed in the lower surfaces of the upper needle plate 31 near the front end of the same to fasten together the upper needle bed base plate 19 and the upper needle plates 31. Upper needles 38 are received slidably in upper needle grooves 37 formed between the adjacent upper needle plates 31.

The needle plate head portions 11 of the lower needle plates 3A and the needle plate head portions 11 of the lower needle plates 3B are entirely the same in shape. A sinker spacer 41, a sinker 42, a sinker jack 43 and a knock-over bit 44 are provided on each needle plate head portion 11, which will be described in detail with reference to FIGS. 2a, 2b, 3a, 3b, 3c and 6 to 13.

The sinker spacer 41 is placed on a step 45 formed on the needle plate head portion 11 of each of the lower needle plates 3A and 3B. The sinker spacer 41 (FIG. 11a, b) is provided with a recess 46 having a shape resembling the inverted letter U in its rear lower portion, a recess 48 for receiving a band 47 in its upper edge, and a presser lug 49 for holding down the lower needle 23, formed by bending the lower end of its front portion. The sinker spacer 41 is put on and fastened to the needle plate head portion 11 with its recess 46 positioned on an enlarged step 50 (FIGS. 3a, 3b and 6) formed on the needle plate head portion 11, with the recess 46 engaging a wire 51 passed through holes 18B formed in the lower needle plates 3A and 3B, and with a recess 52 formed in its lower front portion engaging a wire 53 passed, similarly to the wire 51, through holes formed in the lower needle plates 3A and 3B.

Figure 7:
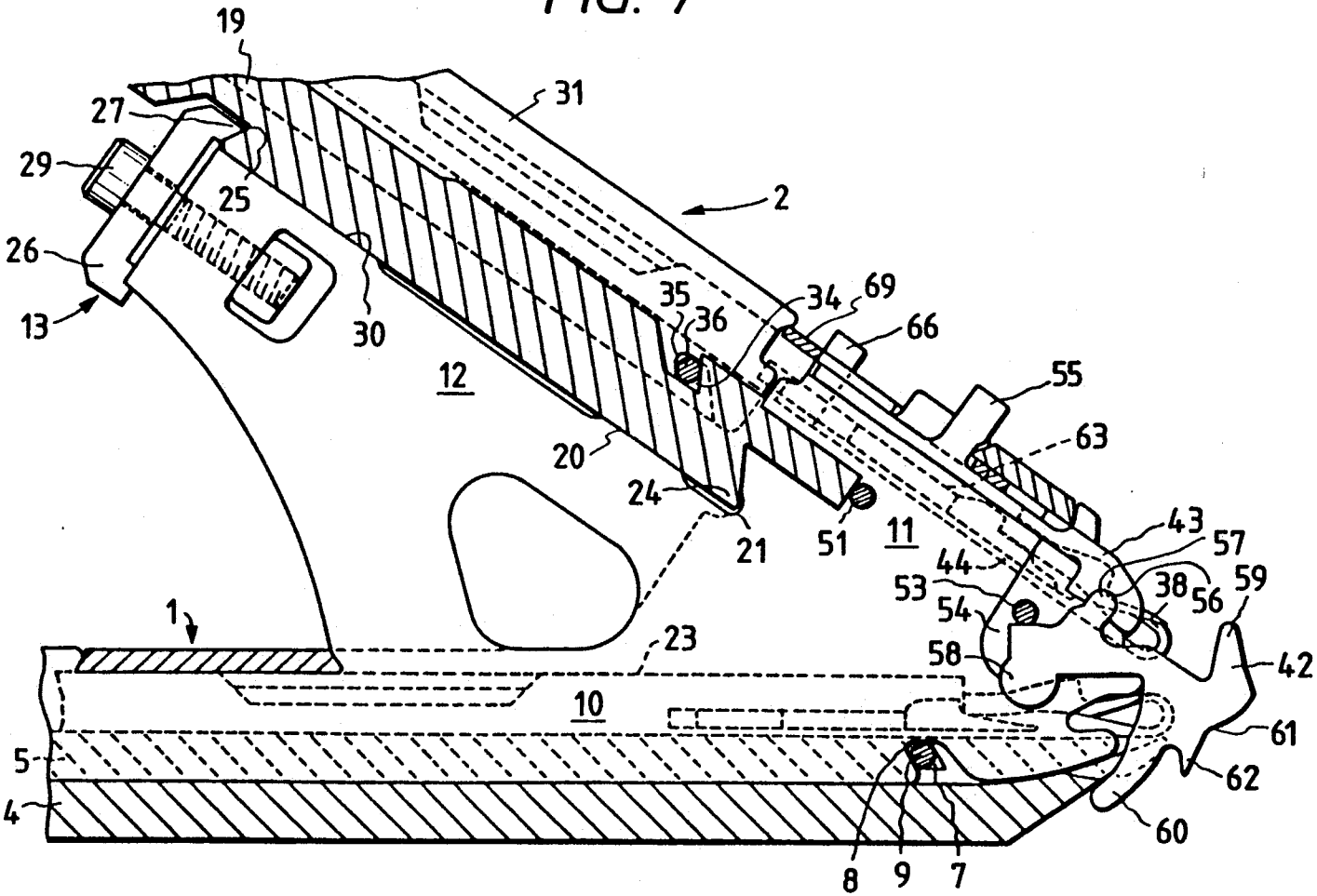
FIG. 7 is a sectional view taken on line VII—VII in FIG. 9.
Figure 8:
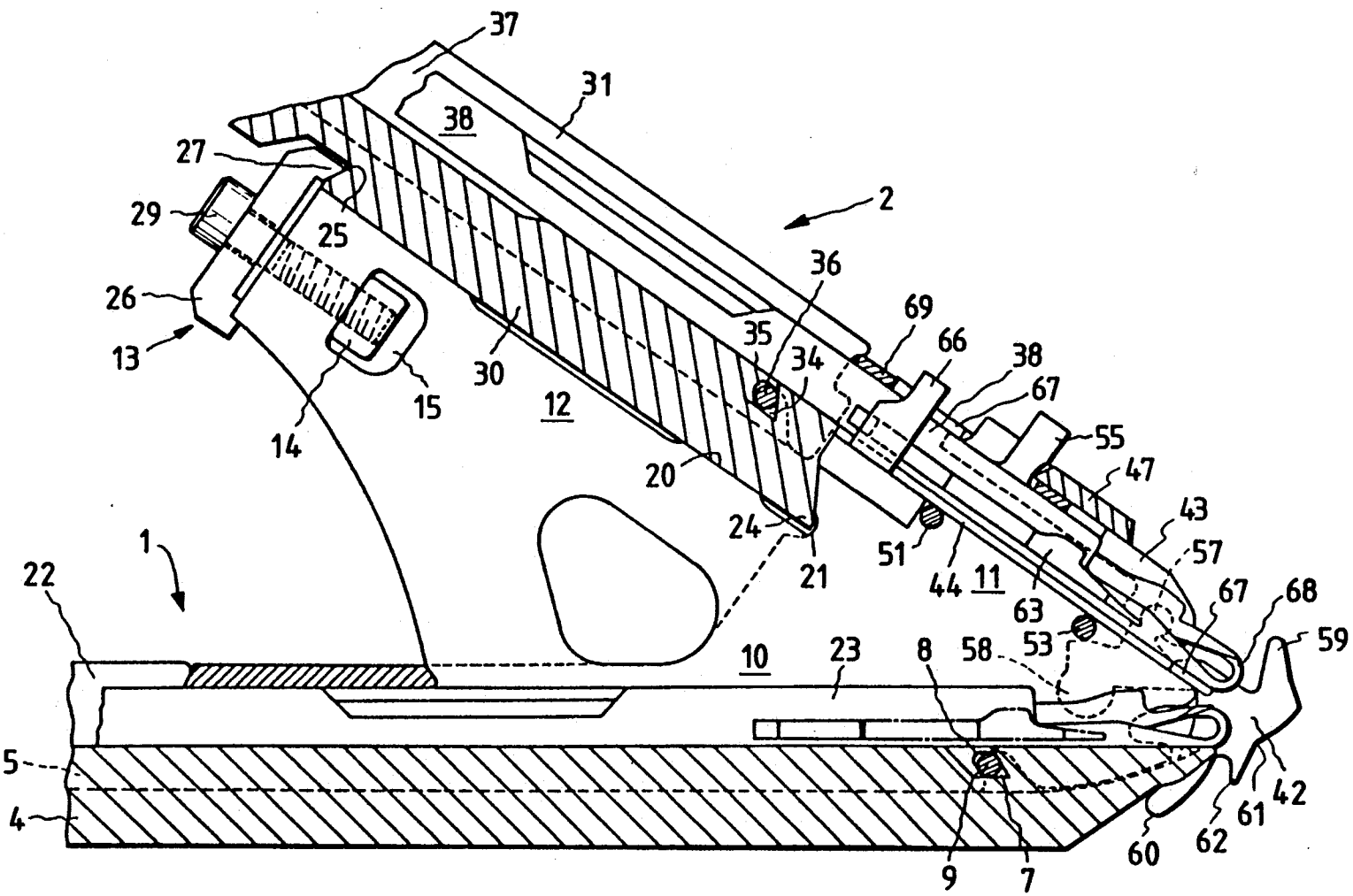
FIG. 8 is a sectional view taken on line VIII—VIII in FIG. 9.
Figure 9:
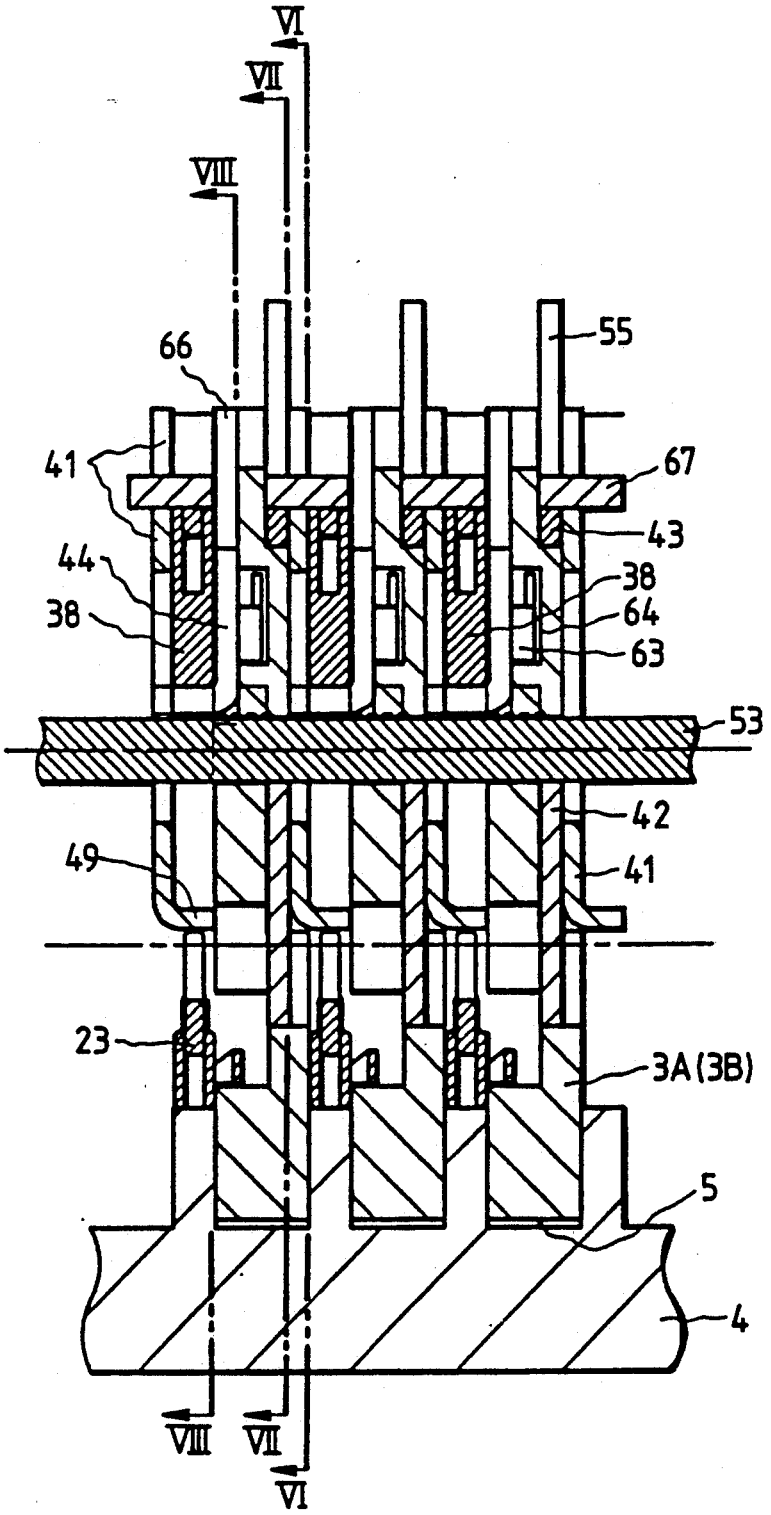
FIG. 9 is a sectional view taken on line IX—IX in FIG. 6.
Figure 11A:
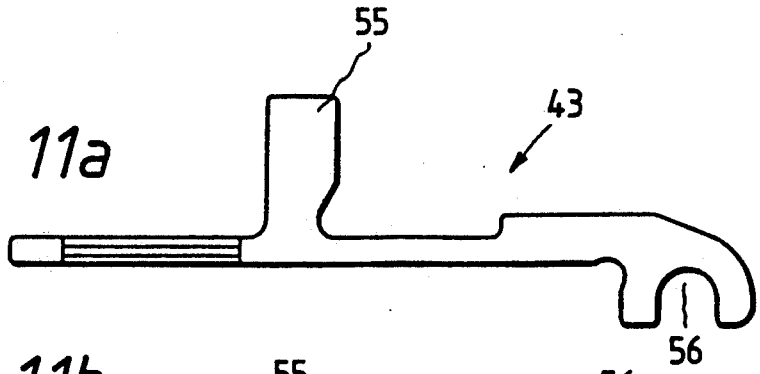
FIGS. 11*a* and 11*b* are a side view and a bottom view, respectively, of a sinker jack.
Figure 11B:
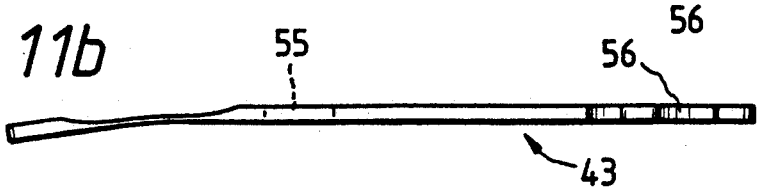
Figure 12:
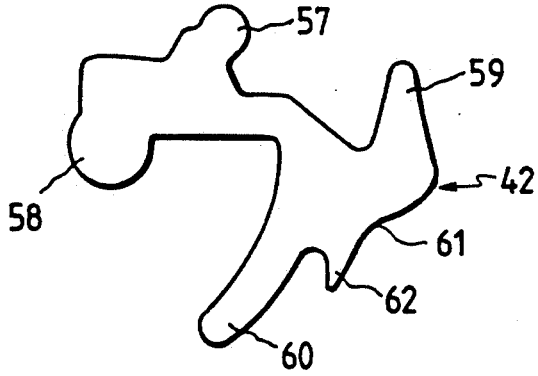
FIG. 12 is a side view of a sinker.
Figure 13:
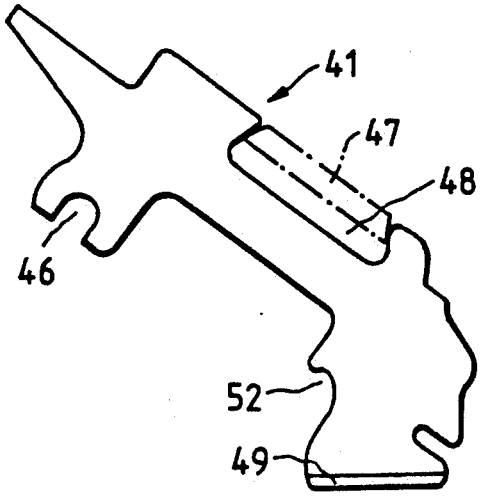
FIG. 13 is a side view of a sinker spacer.

When the sinker spacer 41 is thus fastened to the needle plate head portion 11, a gap is formed between the upper portion of the sinker spacer 41 and the upper portion of the needle plate head portion 11 by a top step 54 (FIG. 3c) formed on the needle plate head portion 11, and the sinker jack 43 is inserted in the gap (FIG. 7). The top step 54 extends to the front end of the needle plate head portion 11, and the sinker 42 is put on the front end of the needle plate head portion 11. As shown in FIG. 11a, b the sinker jack 43 has the shape of an elongate plate. The relatively thin rear portion of the sinker jack 43 is bent in a gentle curve to restrain the sinker jack 43 frictionally from free movement in the gap defined by the step 54. The sinker jack 43 is provided with a butt 55 on its upper edge, and a downwardly opening recess 56 in its front portion. The recess 56 engages a projection 57 formed on the upper edge of the sinker 42. As mentioned above, the sinker 42, similarly to the sinker jack 43, is inserted in the gap defined by the step 54 in the front end of the needle plate head portion 11 with a pivotal protrusion 58 formed in its rear end fitted in a sinker support hole 16 formed adjacent to a step contiguous with the top step 54, so that the sinker 42 is able to swing on the pivotal protrusion 58. The sinker 42 has a nose 59 projecting upward from its front portion, a nose 60 projecting downward from its front portion, a stitch forming edge 61 extending between the noses 59 and 60, and a stitch holding projection 62.

Figure 14A:
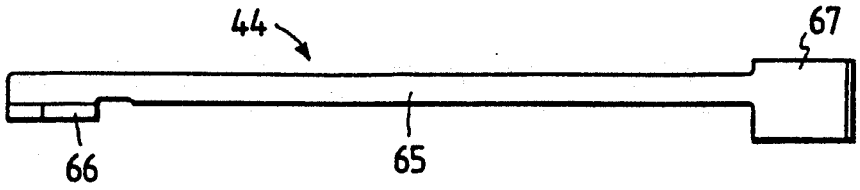
FIGS. 14*a*, 14*b* and 14*c* are a plan view, a side view and a back view, respectively, of a knock-over bit.
Figure 14B:
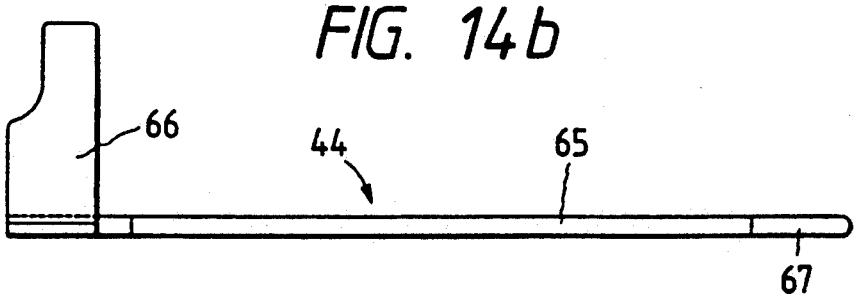
Figure 14C:
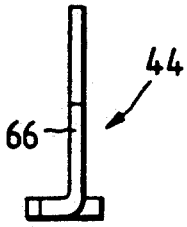

A guide groove 64 for slidably receiving the transfer butt 63 of the upper needle 38 is formed behind the step 45. The knock-over bit 44 is put on the wires 51 and 53 for sliding on the side of the guide groove 64. The knock-over bit 44 has a shank 65 having the shape of a flat plate, a butt 66 at the rear end of the shank 65, and a square loop presser 67 at the front end of the shank 65 (as shown in FIGS. 14a, 14b). The upper needle 38 is placed on the upper edge of the shank 65 with its hook 68 positioned above the loop presser 67. The teeth of a needle plate spacer 69 having the shape of a comb are fitted in the spaces between the needle plate head portions 11 so that the needle plate head portions 11 are arranged accurately at regular intervals to hold the butts 66 of the knock-over bits 44 and the butts 55 of the sinker jacks 43 accurately in place. Cams provided on an upper carriage engage the butt 66 of the knock-over bit 44 to raise and retract the knock-over bit 44 along the corresponding upper needle 38.

Figure 15:
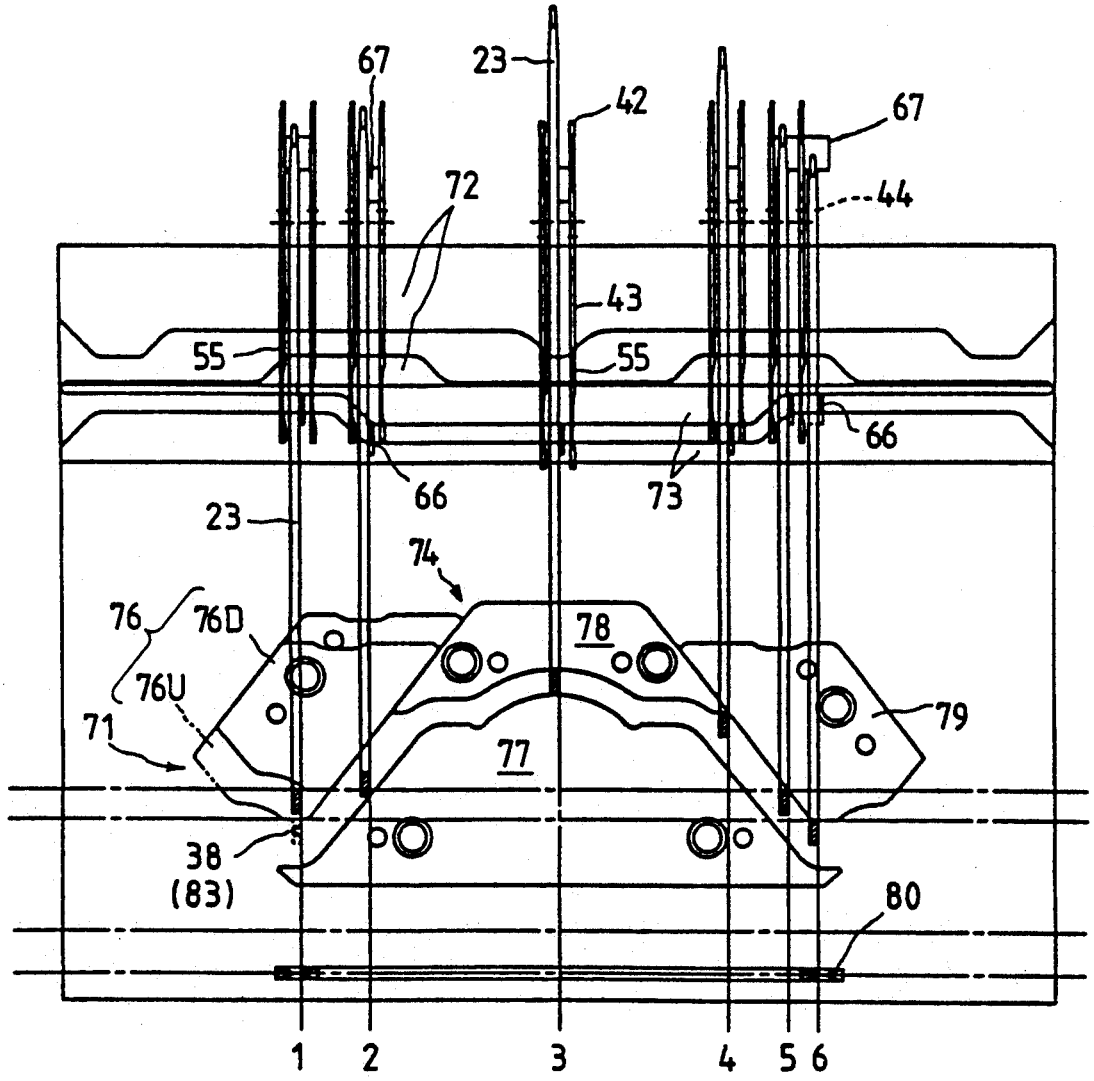
FIG. 15 is a plan view of cams arranged on an upper carriage and a lower carriage, in which an upper needle bed and a lower needle bed are superposed.

An upper lock 71, a sinker cam 72 and a knock-over bit cam 73 for operating the upper needles 38, the sinker jacks 43 and the knock-over bits 44 provided on the upper needle bed 2 are provided on the upper carriage. A lower lock 74 for operating the lower needles 23 are provided on a lower carriage 75. FIG. 15 shows the upper lock 71, the sinker cam 72, the knock-over bit cam 73, the upper needles 38 and lower needles 23 in a superposed arrangement in a plan view, in which the lock 71 on the upper carriage is indicated by alternate long and short dash lines, the upper needles 38 are indicated by dotted lines, the sinker cam 72 and the knock-over bit cam 73 are indicated by continuous lines, the lock 74 on the lower carriage 75 and the lower needles 23 are indicated by continuous lines. The lock 74 consists of, from left to right, a first stitch cam 76, a raising cam 77, a guard cam 78 and a second stitch cam 79. Pressers 80 provided on the upper carriage and the lower carriage 75, respectively, engage the butts 82 of select jacks 81 associated with the upper needles 38 and lower needles 23 to press the needles 23 and 38 to their rest positions.

Figure 10:
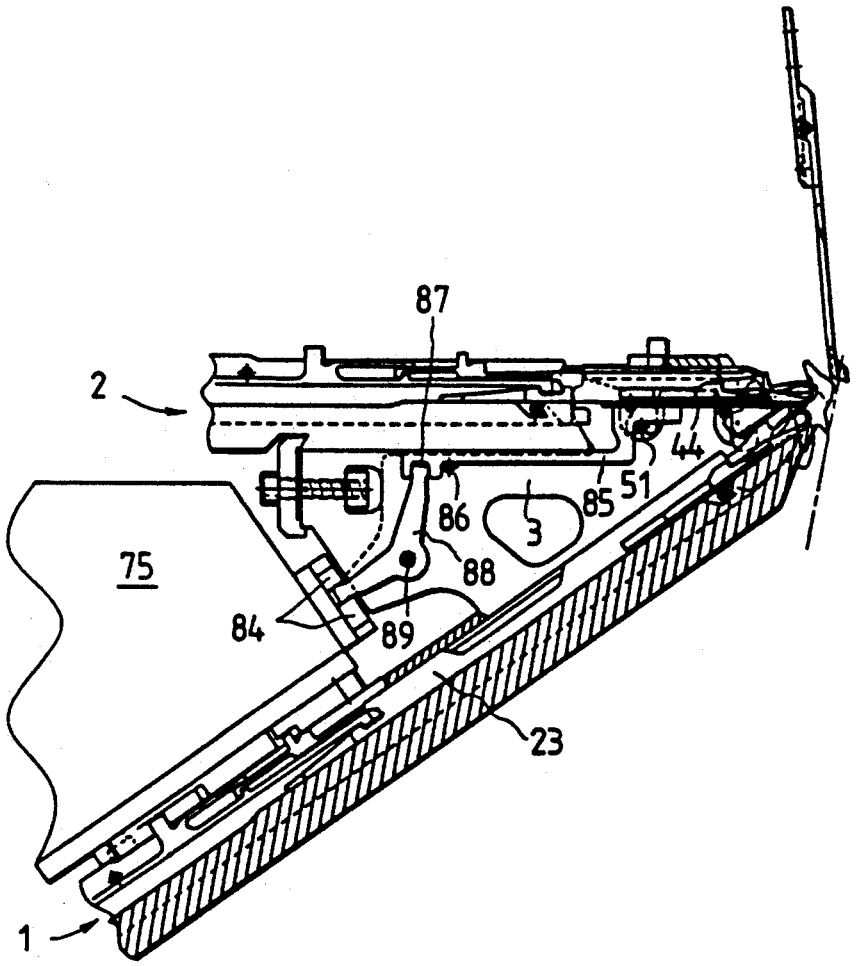
FIG. 10 is a longitudinal sectional view of the head portions of needle beds provided with knock-over bits employed in a flat knitting machine in a second embodiment according to the present invention.

In a multibed flat knitting machine in a second embodiment according to the present invention, knock-over bits 44 provided on an upper bed 2 are operated by a cam 84 provided on a lower carriage 75 to operate lower needles 23 arranged on a lower needle bed 1 as shown in FIG. 10. The knock-over bit 44 is fixedly provided on its lower end with a sliding plate 85 having the shape of a crank. The sliding plates 85 of the knock-over bits 44 are placed between adjacent needle plates 3A and 3B supported in a parallel arrangement on wires 51 and 86. Swing levers 88 are supported pivotally by pins 89 on the needle plated 3A and 3B. One end of the swing lever 88 engages a recess 87 formed in one end of the sliding plate 85 and the other end of the same engages a knock-over cam 84 provided on the lower carriage 75. The knock-over cam 84 turns the swing lever 88 to advance and retract the knock-over bit 44 through the sliding plate 85.

In operation, the cams, not shown, provided on the carriages operates the needles of the corresponding beds 1 and 2, the knock-over bits 44 are retracted together with the corresponding upper needles 38 of the upper needle bed 2 according to the operation of the corresponding lower needles 23 to avoid interference between the lower needles 23 and the corresponding knock-over bits 44 and, as shown in FIG. 16, the sinker jacks 43 are operated to turn the sinkers 42 in a vertical plane. FIGS. 15, 18a, 18b, 18c, 19a, 19b and 19c show the sequential steps of operation of the needles 23 and 38, the sinker jack 43, the sinker 42 and the knock-over bit 44 in forming a stitch by the lower needle 23.

In forming a stitch by the lower needle 23, upper needle 38 and the loop presser 67 of the knock-over bit 44 must be retracted from the path of the lower needle 23 in order that the rising movement of the lower needle 23 will not be obstructed. The movement of the upper needle 38, the lower needle 23 and the knock-over bit 44 will be described hereinafter with reference to FIGS. 15, 18a, 18b and 18c.

Figure 16A:
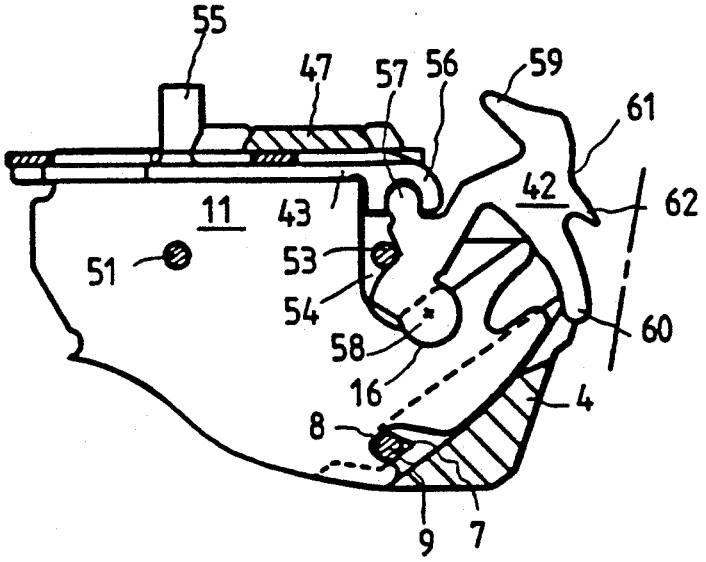
FIGS. 16*a* and 16*b* are longitudinal sectional views of the head portion of the needle bed, in which a sinker is turned to the upper position in FIG. 16*a* and the same is turned to the lower position in FIG. 16*b*.
Figure 19A:
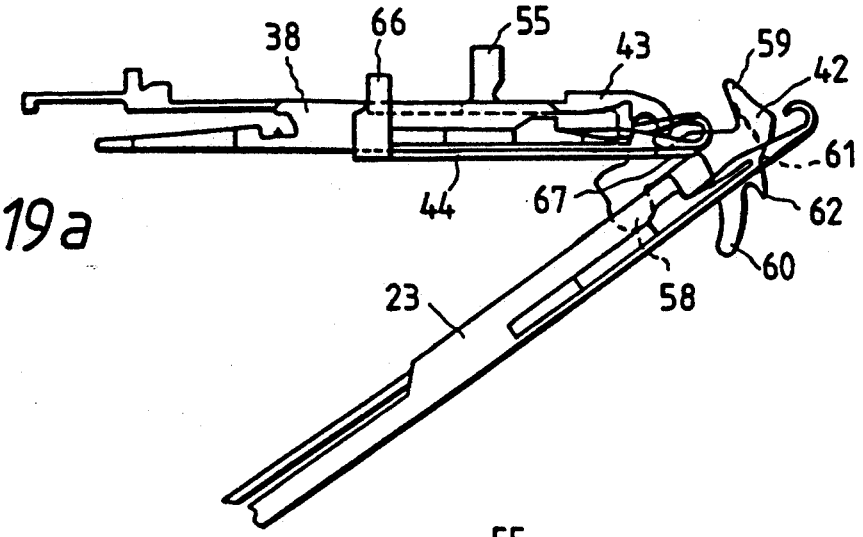
FIGS. 19*a*, 19*b* and 19*c* are side view showing the sequential motions of the stitching components to be performed subsequent to the state shown in FIG. 18*c*.
Figure 19B:
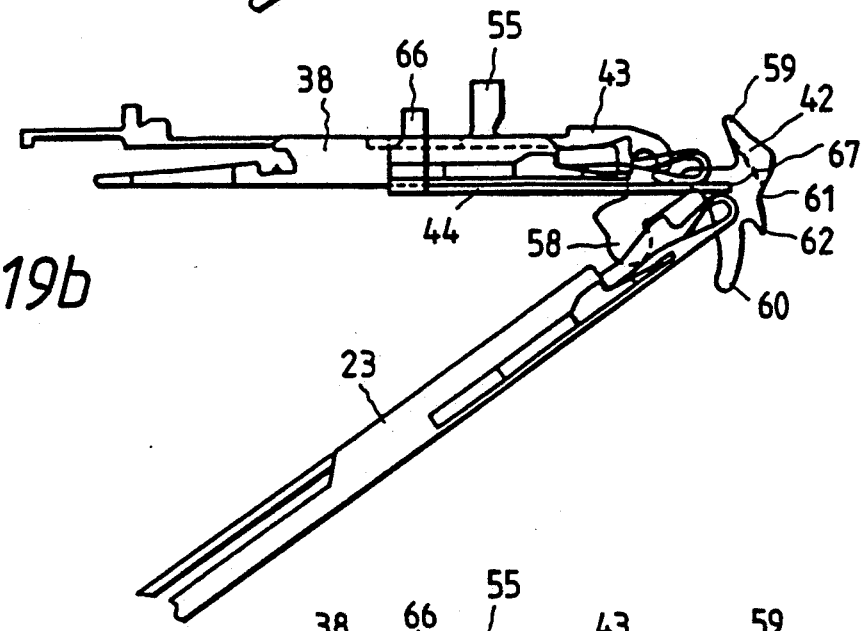
Figure 19C:
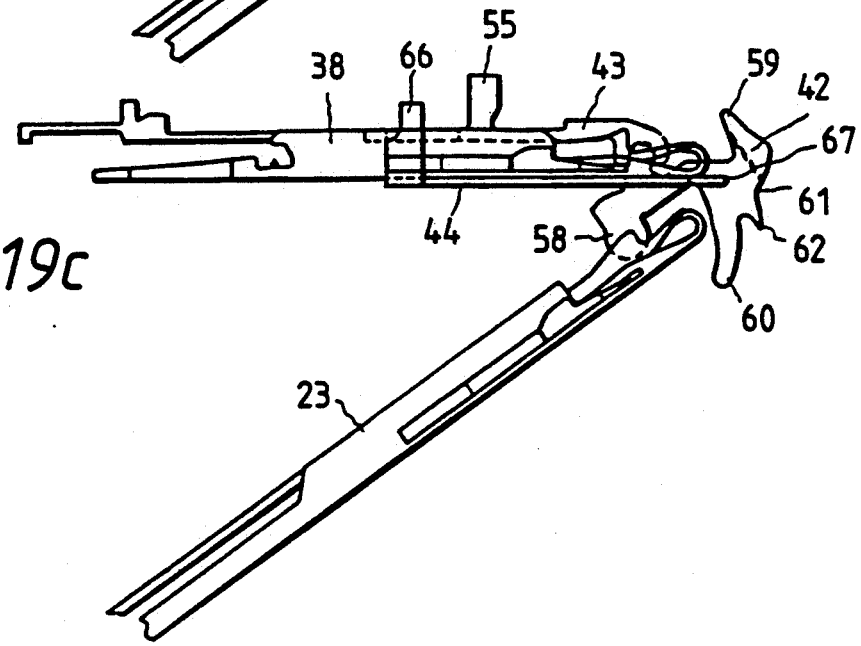

Referring to FIG. 15, supposing that the upper carriage and the lower carriage 75 are moved to the left, the stitch cam 76U of the lock 71 on the upper carriage 70 is held at an upper needle rest position indicated by alternate long and two short dashes lines to lower the butt 83 of the upper needle 38 to the rest position indicated by dotted lines. In this state, the presser 80 (FIG. 15) engages the butt 82 of the select jack 81 (FIG. 1) associated with the upper needle 38 to press the butt 82 into the needle groove 37. Consequently, the raising cam 77 travels without engaging the needle butt 83 and thereby the upper needle 38 remains at the rest position. In this state, the butt 66 of the knock-over bit 44 is moved to the advanced position by the knock-over bit cam 73 and the sinker jack butt 55 is moved to the advanced position by the sinker cam 72, whereby the sinker 42 is turned clockwise to a position 1 in FIG. 15 and shown in FIG. 18*a*. On the other hand, since the knitting cam 76D of the lock 74 on the lower carriage 75 is at a position indicated by continuous lines in FIG. 15 and the lower needle 23 is not lowered to the rest position, the lower needle 23 is raised gradually by the raising cam 77 as the lower carriage 75 travels. In this state, the knock-over bit cam 73 lowers the butt 66 of the knock-over bit 44 to retract the loop presser 67 of the knock-over bit 44 from the path of the lower needle 23. The sinker 42 remains at the position 1 (a position 2 in FIG. 15) as shown in FIG. 17*b*. The lower needle 23 is raised by the raising cam 77 to the uppermost position, the knock-over bit 44 stays at the position 2 shown in FIG. 15, the sinker jack butt 55 is lowered by the sinker cam 72 to turn the sinker 42 counterclockwise (FIGS. 17*c* and 16*a*) so that the sinker 42 will not interfere with a yarn feeder 90. While the lower needle 23 moves between positions 3 and 4 shown in FIG. 15, the yarn is fed to the lower needle 23. Then, the guard cam 79 engages the butt 89 of the lower needle 23 to lower the lower needle 23. In this state, the knock-over bit 44 remains at the lower position and the sinker cam 72 advances the sinker jack 43 to turn the sinker 42 clockwise (a position 4 shown in FIG. 15) as shown in FIG. 19*a*. As the lower needle 23 is lowered further by the stitch cam 79, the knock-over bit cam 73 advances the butt 66 of the knock-over bit 44 to move the loop presser 67 of the knock-over bit 44 to the uppermost position. The sinker 42 is at a position 5 shown in FIG. 15 as shown in FIG. 19*b*. Then, the lower needle 23 is lowered by the stitch cam 79 to the lowermost position, the knock-over bit 44 is raised to the uppermost position and the sinker 42 remains at the same position.

Figure 16B:
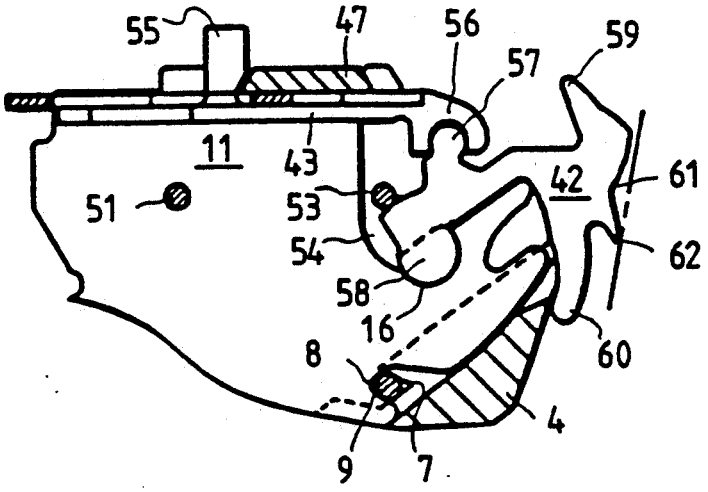
Figure 17A:
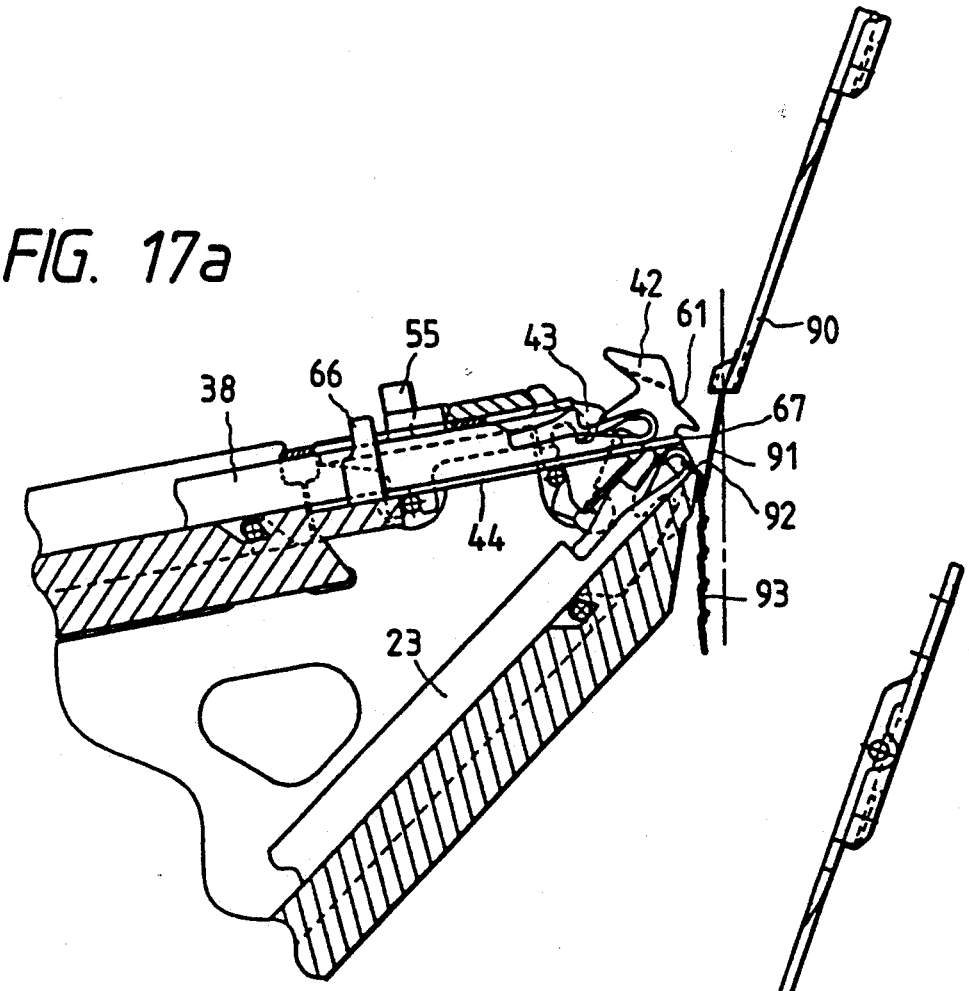
FIGS. 17*a* and 17*b* are longitudinal sectional views of the head portions of the needle beds showing the positional relation between the sinker, the needle and a loop in forming a stitch by a lower needle, in which the sinker is turned to the upper position in FIG. 17*a* and the same is turned to the lower position in FIG. 17*b*.
Figure 17B:
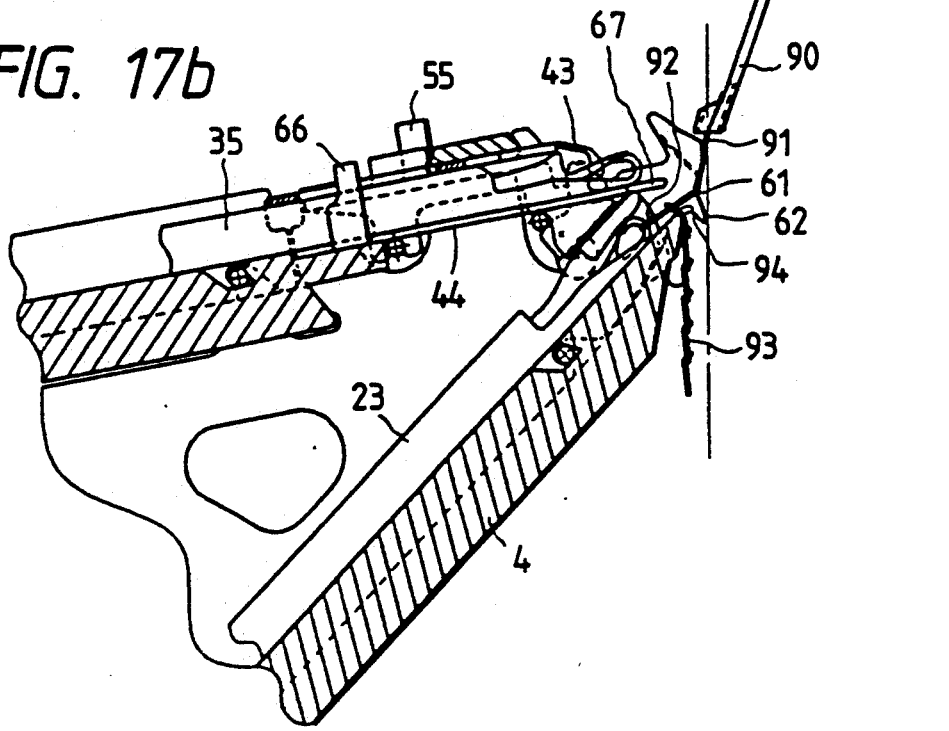
Figure 18A:
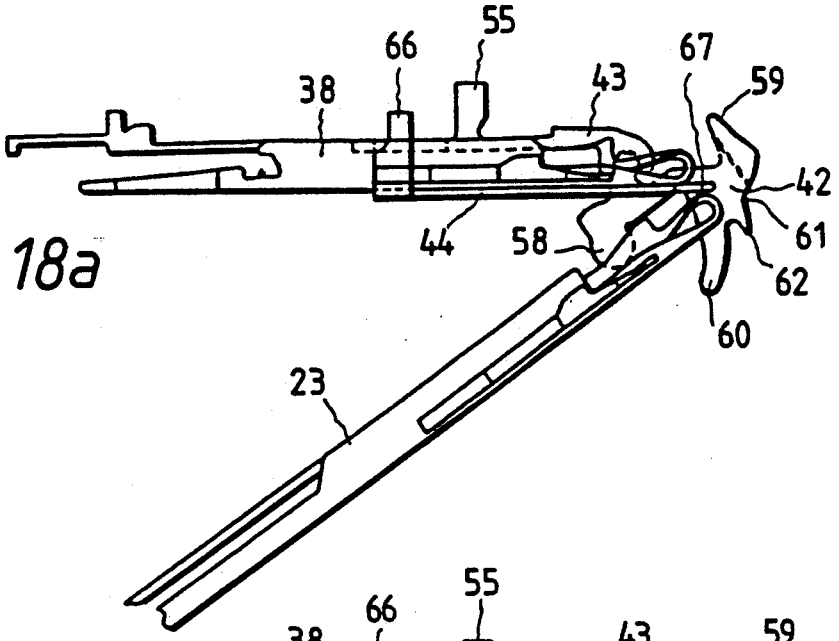
FIGS. 18*a*, 18*b* and 18*c* are side views showing the sequential motions of the sinker jack, the sinker, the knock-over bit, the upper needle and the lower needle in forming a stitch by the lower needle.
Figure 18B:
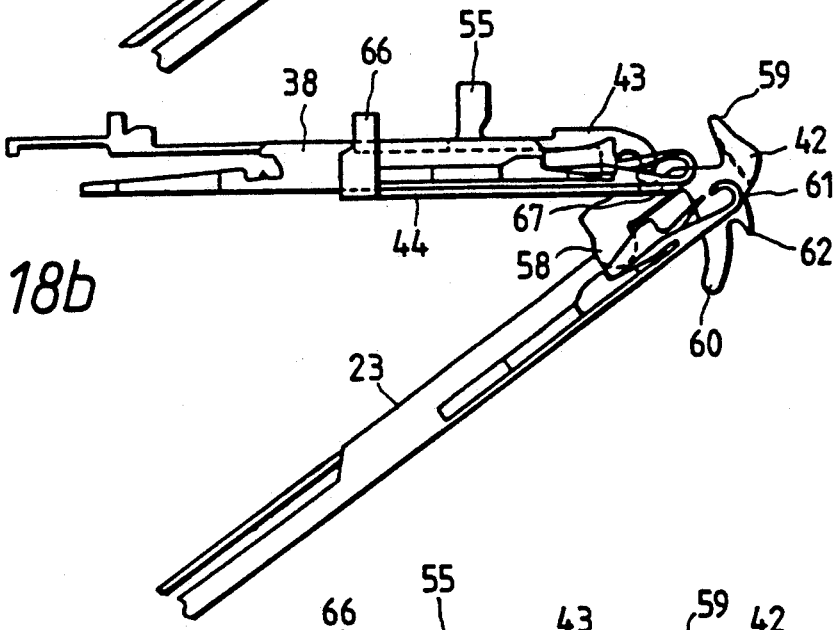
Figure 18C:
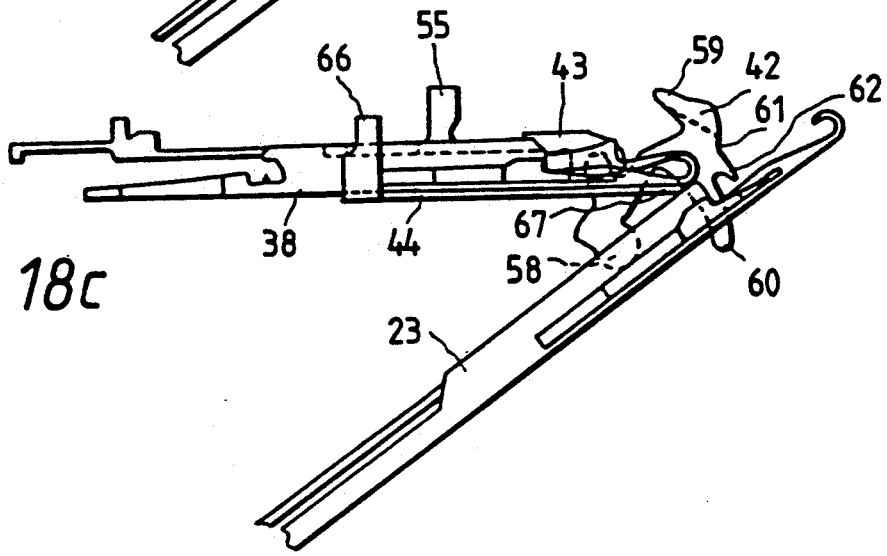

The sinker 42 turns vertically in synchronism with the movement of the yarn feeder 90 as shown in FIGS. 17*a* and 17*b*. In feeding the yarn 91 to the lower needle 23 the sinker 42 is turned to the upper position to enable the yarn feeder 9 to approach the hook of the lower needle 23 to feed the yarn 91 to the lower needle 23. Since the sinker 42 is supported pivotally on the needle plate head portion 11 with the pivotal protrusion 58 thereof received pivotally in the sinker support hole 16 of the needle plate head portion 11 as shown in FIGS. 16*a* and 16*b*, the sinker 42 turns counterclockwise on the pivotal protrusion 58 when the sinker jack 43 slides to the left as viewed in FIGS. 16*a* and 16*b* to clear the path of the yarn feeder 90. The sinker 42 is turned clockwise to a sinker loop forming position when the sinker jack 43 slides to the right. Immediately after the yarn 91 has been fed to the lower needle 23 (FIG. 18*c*), the sinker jack 43 is raised to turn the sinker 42 downward (FIG. 19*a*), so that the stitch forming edge 61 of the sinker 42 engages the yarn 91 to form a loop 92 of a predetermined size between the stitch forming edge 61 and the hook of the lower needle 23. Thus, a new loop 92 is formed and, at the same time, the stitch holding projection 62 of the sinker 42 depresses the sinker loop 94 of the fabric 93 as the sinker 42 is turned downward.

Figure 20A:
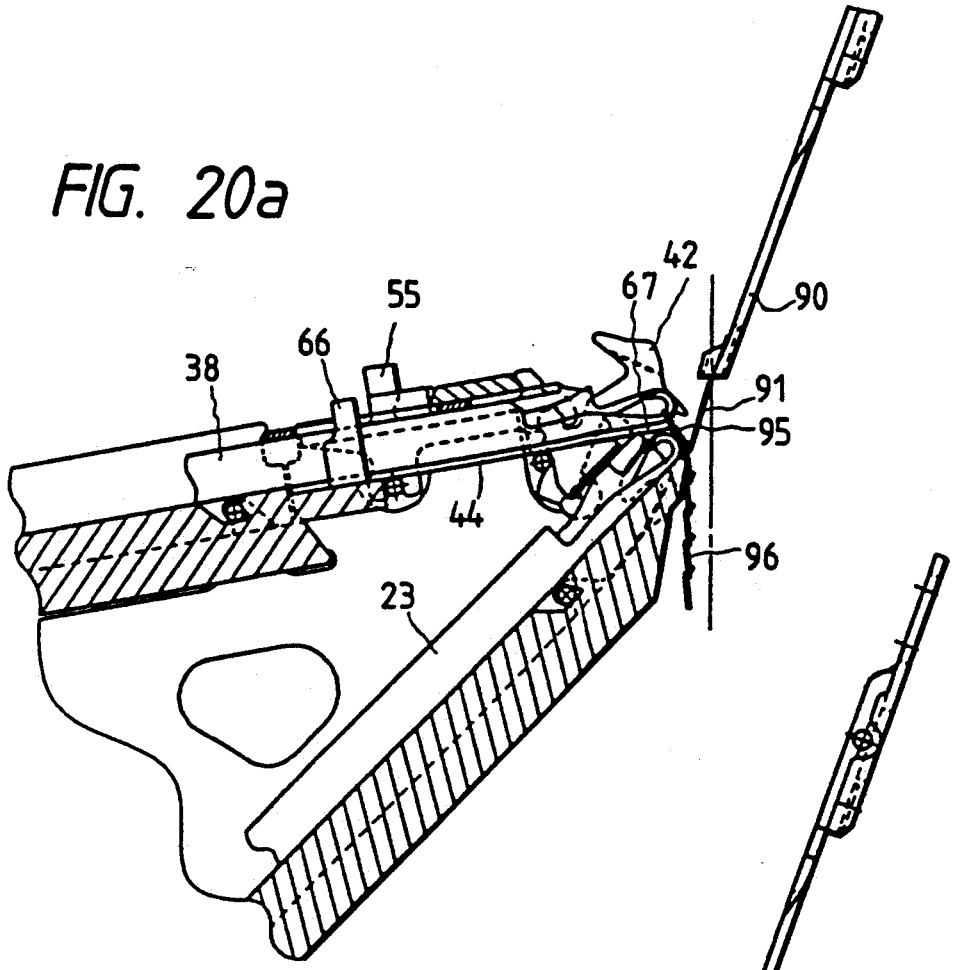
FIGS. 20*a* and 20*b* are longitudinal sectional views of the needle beds, showing the relation between the sinker, the needle and a loop in forming a stitch by the upper needle, in which the sinker is turned to the upper position in FIG. 20*a* and the same is turned to the lower position in FIG. 20*b*.
Figure 20B:
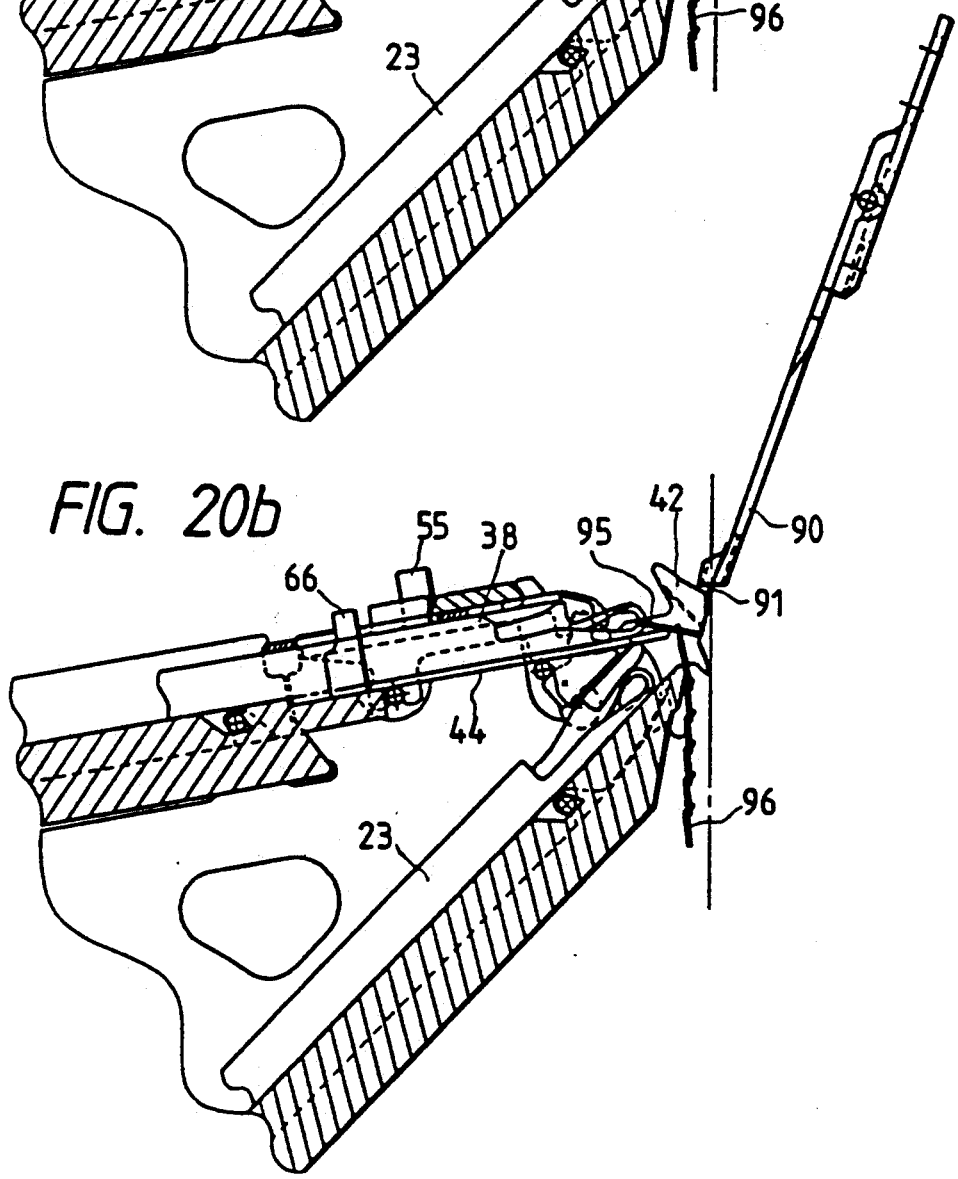
Figure 21A:
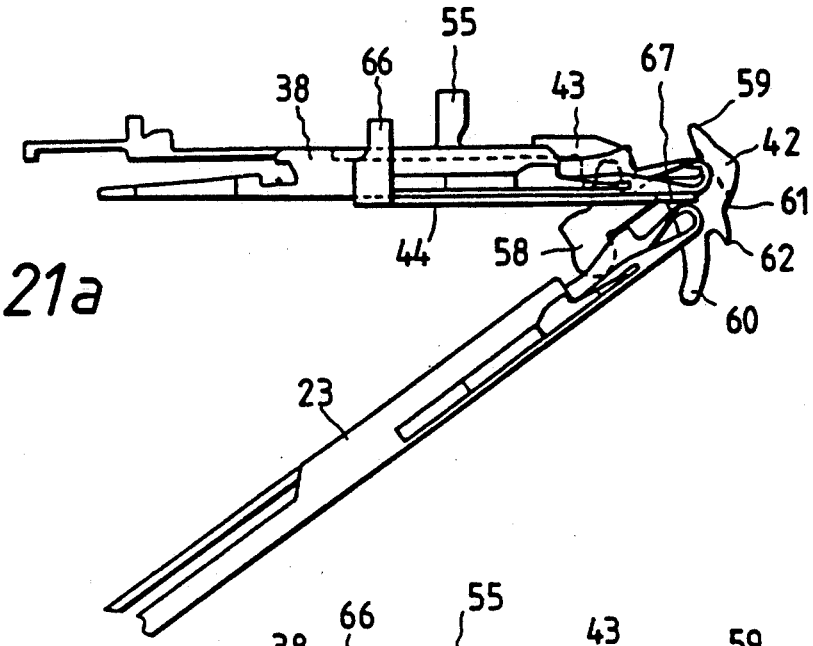
FIGS. 21*a*, 21*b* and 21*c* are side views of assistance in explaining the sequential motions of the sinker jack, the sinker, the knock-over bit, the upper needle and the lower needle in forming a stitch by the upper needle.
Figure 21B:
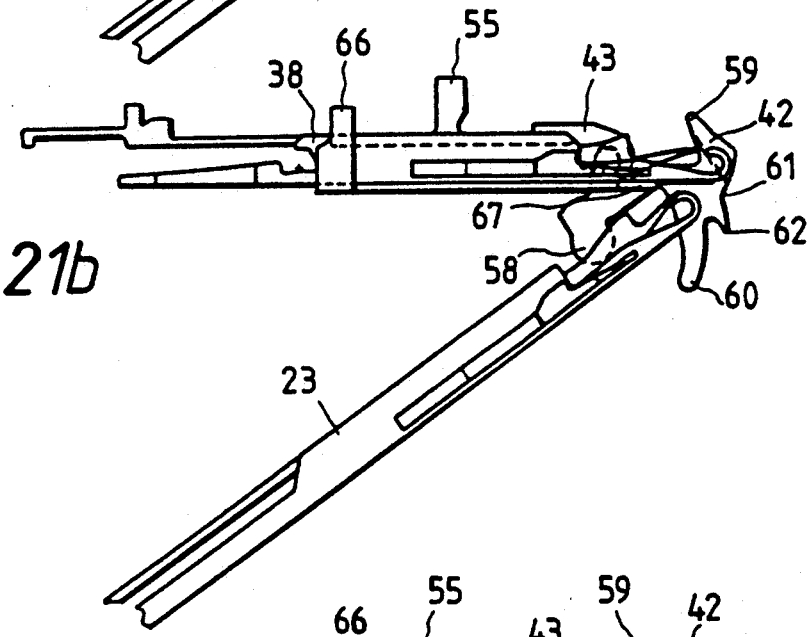
Figure 21C:
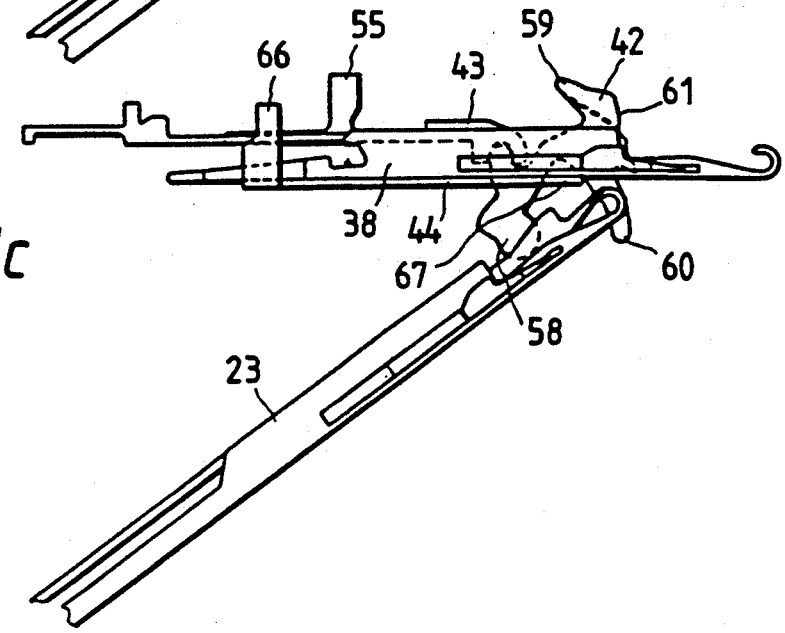

The swing motion of the sinker 42 in forming a stitch by the upper needle 38 is shown in FIGS. 20*a* and 20*b*, and the sequential motions of the needle, the sinker jack and the knock-over bit are shown in FIGS. 21*a*, 21*b*, 22, 22*b* and 22*c*. In forming a stitch by the upper needle 38, a loop 95 is formed by the yarn 91 caught by the hook of the upper needle 38, and the loop presser 67 of the knock-over bit 44 presses the fabric 96 continuous with the loop 95 to restrain the fabric 96 from being pulled by the upper needle 38 as the upper needle 38 is lowered.

The knitting method and the flat knitting machine of the present invention retracts the knock-over bit for guiding and supporting the upper needle, slidably provided in the front end of the upper needle bed from the path of the lower needle in forming a stitch by the lower needle, and the same is advanced to support the upper needle and the loop formed by the hook of the upper needle is held by the loop presser of the knock-over bit in forming a stitch by the upper needle. Accordingly, the upper needle bed supporting the upper needles need not be retracted in forming stitches by the lower needles and the flat knitting machine need not be provided with any mechanism for retracting the upper needle bed, which simplifies the construction of the flat knitting machine.

What is claimed is:

1. A method of knitting a weft knitted fabric using a multibed flat knitting machine, comprising:

providing an upper needle bed having a head portion, providing a lower needle bed having a head portion under the upper needle bed, the head portion of the lower needle bed being located adjacent to the head portion of the upper needle bed, providing an upper needle having a needle hook, the upper needle defining a sliding direction and an advanced position, providing a lower needle for stitching, providing a knock-over bit located in the head portion of the upper needle bed and having a loop holder, the knock-over bit being slidable in a direction parallel to the sliding direction defined by the upper needle, advancing the knock-over bit to a position in which the loop holder of the knock-over bit supports the needle head of the upper needle when the upper needle is in the advanced position, raising the lower needle, and retracting the knock-over bit to a position in which a collision between the lower needle and the knock-over bit is avoided when the lower needle is raised.

2. A multibed flat knitting machine comprising:

an upper needle bed having a head portion, a lower needle bed disposed under the upper needle bed and having a head portion, the head portion of the lower needle bed being located adjacent to the head portion of the upper needle bed, an upper needle having a needle hook, the upper needle defining a sliding direction and an advanced position, a lower needle that is raisable for stitching, a knock-over bit located in the head portion of the upper needle bed and having a loop holder, the knock-over bit being slidable in a direction parallel to the sliding direction defined by the upper needle, means for advancing the knock-over bit to a position in which the loop holder of the knock-over bit supports the needle head of the upper needle when the upper needle is in the advanced position, and means for retracting the knock-over bit to a position in which a collision between the lower needle and the knock-over bit is avoided when the lower needle is raised.

3. A multibed flat knitting machine comprising:

an upper needle bed having a head portion, a lower needle bed disposed under the upper needle bed and having a head portion, the head portion of the lower needle bed being located adjacent to the head portion of the upper needle bed, an upper needle having a needle hook, the upper needle defining a sliding direction and an advanced position, a lower needle that is raisable for stitching, a knock-over bit located in the head portion of the upper needle bed and having a loop holder, the knock-over bit being slidable in a direction parallel to the sliding direction defined by the upper needle, the knock-over bit being advancable to a position in which the loop holder of the knock-over bit supports the needle head of the upper needle when the upper needle is in the advanced position, and the knock-over bit being retractable to a position in which a collision between the lower needle and the knock-over bit is avoided when the lower needle is raised, wherein the upper needle bed is supported on the lower needle bed by lower needle plates inserted in needle plate grooves formed in a needle bed base plate, and wherein the lower needle plate comprises:

a lower needle guide portion extending between the front edge and the rear edge of the lower needle bed, the lower needle guide portion having a front end, a needle plate head portion extending upward from the front end of the lower needle guide portion, and an upper needle bed base plate supporting portion extending upward from the upper edge of the lower needle plate at a position behind the needle plate head portion, and wherein the needle plate head portion comprises: a sinker, a sinker spacer, a sinker jack, and a knock-over bit.

4. The multibed flat knitting machine of claim 3, wherein the knock-over bit comprises:

a substantially flat shank having a front end, a rear end, and an upper edge, a butt located at the rear end of the shank, a loop presser located at the front end of the shank, and wherein the upper needle is positioned on the upper edge of the shank and the hook of the upper needle is positioned above the loop presser.

5. The multibed flat knitting machine of claim 4, comprising an upper carriage having a cam, the cam being positioned to engage the butt of the knock-over bit, whereby the knock-over bit is advancable or retractable relative to a needle.

6. The multibed flat knitting machine of claim 3, comprising:

a sliding plate fixed to the knock-over bit, the sliding plate having a recess formed therein, a knock-over cam provided on the lower carriage, a swing lever supported pivotally on the lower needle plate, the swing lever having a first end and a second end, the first end of the swing lever engaging the recess in the sliding plate, the second end of the swing lever engaging the knock-over cam provided on the lower carriage, whereby the cam turns the swing lever to advance and retract the bit through the sliding plate.

* * * * *